US007845905B2

(12) United States Patent
Ahmad et al.

(10) Patent No.: US 7,845,905 B2
(45) Date of Patent: Dec. 7, 2010

(54) HOLLOW TURBINE BLADE

(75) Inventors: Fathi Ahmad, Kaarst (DE); Michael Dankert, Offenbach (DE)

(73) Assignee: Siemens Aktiengesellschaft, Munich (DE)

( * ) Notice: Subject to any disclaimer, the term of this patent is extended or adjusted under 35 U.S.C. 154(b) by 797 days.

(21) Appl. No.: 11/510,239

(22) Filed: Aug. 25, 2006

(65) Prior Publication Data

US 2007/0128035 A1 Jun. 7, 2007

(30) Foreign Application Priority Data

Aug. 26, 2005 (EP) ..... 05018595

(51) Int. Cl.
*F01D 5/14* (2006.01)

(52) U.S. Cl. ..... 416/96 R; 416/233; 416/236 R

(58) Field of Classification Search ..... 416/95, 416/96 R, 96 A, 224, 231 B, 231 R, 233, 416/236 R
See application file for complete search history.

(56) References Cited

U.S. PATENT DOCUMENTS 2,807,870 A * 10/1957 Harness ..... 29/889.61
2,882,974 A * 4/1959 Boegehold ..... 416/233
2,933,286 A * 4/1960 Klint et al. ..... 416/220 R
3,290,004 A * 12/1966 Ishibashi ..... 416/90 R
5,690,473 A * 11/1997 Kercher ..... 416/97 A
7,318,699 B2 * 1/2008 Serafini et al. ..... 415/169.4

FOREIGN PATENT DOCUMENTS

| | | |
|---|---|---|
| EP | 1 508 399 A1 | 2/2005 |
| EP | 1 512 489 A1 | 3/2005 |
| EP | 1 525 942 A1 | 4/2005 |
| JP | 10 061406 A | 3/1998 |
| JP | 2000 018 01 A | 1/2000 |

* cited by examiner

*Primary Examiner*—Nathaniel Wiehe

(57) ABSTRACT

A hollow turbine blade is provided including an airfoil profile which is formed by a suction-side profile wall and a pressure-side profile wall and around which a hot gas can flow and which has a profile height, directed along a blade axis, from a platform up to a profile tip, having at least one supporting rib which is provided in the interior of the turbine blade and connects the pressure-side profile wall to the suction-side profile wall in a respective connecting region, and having at least one slot provided in the profile wall on the hot-gas side and extending along the blade axis. The slot of the turbine blade, on the hot-gas side in the profile wall, is opposite the connecting region formed by the supporting rib and the profile wall.

15 Claims, 2 Drawing Sheets

HOLLOW TURBINE BLADE

CROSS REFERENCE TO RELATED APPLICATIONS

This application claims the benefits of European Patent application No. 05018595.8 filed Aug. 26, 2005 and is incorporated by reference herein in its entirety.

FIELD OF THE INVENTION

The invention relates to a hollow turbine blade, having an airfoil profile which is formed by a suction-side profile wall and a pressure-side profile wall and around which a hot gas can flow and which has a profile height, directed along a blade axis, from a platform up to a profile tip, having at least one supporting rib which is provided in the interior of the turbine blade and connects the pressure-side profile wall to the suction-side profile wall in a respective connecting region, and having at least one slot provided in the profile wall on the hot-gas side and extending along the blade axis. The invention also relates to the use of a turbine blade of the generic type.

BACKGROUND OF THE INVENTION

EP 1 508 399 A1 discloses a turbine blade for a gas turbine, which turbine blade, in order to prevent inadmissibly large cracks, spatially limits the growth of said cracks by a slot which runs in the region of the blade leading edge. Cracks which have developed at the blade leading edge can therefore grow in the axial direction at most only up to the slot. This leads to a prolonged service life of the turbine blade.

However, it has been found that crack development—as viewed in the direction of flow—may also occur downstream of the slot, in the center region of the blade profile. The cracks which have developed there may then spread in the direction of the trailing edge. If such a crack has a length which is greater than the maximum admissible crack length, reliable operation of a gas turbine equipped with said turbine blade is no longer ensured, so that this turbine blade has to be exchanged.

SUMMARY OF THE INVENTION

The object of the invention is therefore to provide a turbine blade having a prolonged service life.

The object is achieved by a turbine blade of the generic type in which the slot, on the hot-gas side in the profile wall, is opposite the connecting region formed by the supporting rib and the profile wall.

The invention is based on the knowledge that the material of the airfoil profile heats up on account of the hot gas flowing along on the outside. On the other hand, the supporting rib running in the interior between the pressure-side profile wall and the suction-side profile wall is colder than the heated material of the profile walls. Since, however, the supporting rib merges integrally into the pressure-side or suction-side profile wall, local heat energy, via the connecting region on the inside, is directed from the respective profile wall into the supporting rib and dissipated, so that, in the region in which the supporting rib leads into the profile wall, a reduced material temperature occurs along the connecting region extending over the profile height. In the transverse direction relative to the blade axis, the profile wall is in comparison hotter within wide regions. Consequently, thermally induced stresses which may generate cracks and promote crack growth occur in the material.

In order to reduce these thermally induced cracks, which cause wear, in material of the profile wall, the invention proposes that the slot, on the hot-gas side in the profile wall, be opposite the connecting region formed by the supporting rib and the profile wall. The slot relieves the material by making possible locally greater thermally induced expansions of the profile wall. Consequently, the relief slot leads to a reduction in the thermally induced stresses in the profile wall, and this reduction in the stresses prolongs the service life. The thermal stresses which continue to occur in the airfoil profile then occur on a scale which is harmless to the material. At this location, cracks and/or crack growth occurs less frequently, as a result of which the service life of the turbine blade is prolonged. In addition, the slot can also serve as a crack stopper or crack limiter, as a result of which the service life of the turbine blade can again be prolonged. A gas turbine equipped with this long-life turbine blade has a longer operating period and reduced downtime, since the turbine blade has to be examined less frequently for cracks having critical lengths and possibly has to be exchanged less frequently. In this respect, the maintenance costs of gas turbines can also be reduced and their efficiency further improved by the invention.

Advantageous configurations are specified in the subclaims.

The slot preferably extends along the blade axis and has at least a length of 10%, preferably of at least 20%, of the profile height H. In particular, this measure prolongs the service life of the gas turbine, since the supporting ribs provided in the interior of the turbine blade likewise extend along the blade axis and connect the pressure-side profile wall to the suction-side profile wall in a respective connecting region.

Because the local temperature reductions caused by the comparatively cooler supporting ribs and therefore the local increase in the thermally induced stresses occur in particular in a rounded-off transition region between the platform and the airfoil profile, the slot or slots may also extend into the transition region. The transition region can therefore also preferably be protected from crack development. In addition, crack growth is thus delayed or limited in the transition region. The slot provided in the outer surface around which hot gas flows may also expediently extend beyond the transition region right into the platform.

If the slot has a penetration depth which extends from the hot-gas-side surface of the profile wall right into the connecting region and/or right into the supporting rib, the locally occurring input of coldness, i.e. the heat extraction occurring locally due to the cooler supporting rib, can be reduced in an especially effective manner, as a result of which the material of the profile wall, between the connecting region and the outer surface opposite the latter, is warmer compared with the prior art. Consequently, a temperature distribution made more uniform and therefore a reduced temperature gradient appear along the direction of flow in the profile wall. As a result, the thermal stresses are reduced, which leads to prolongation of the service life of the turbine blade.

In a further advantageous configuration of the invention, the slot is filled with a filler in order to avoid aerodynamic losses, which may possibly occur, in the hot gas on account of edges. Here, the filler is softer than the material of the profile wall. The thermally induced expansions of the profile wall which occur can in this case be compensated for in an especially effective manner by the soft filler.

BRIEF DESCRIPTION OF THE DRAWINGS

The invention is explained with reference to a drawing, in which.

DETAILED DESCRIPTION OF THE INVENTION

Figure 1:
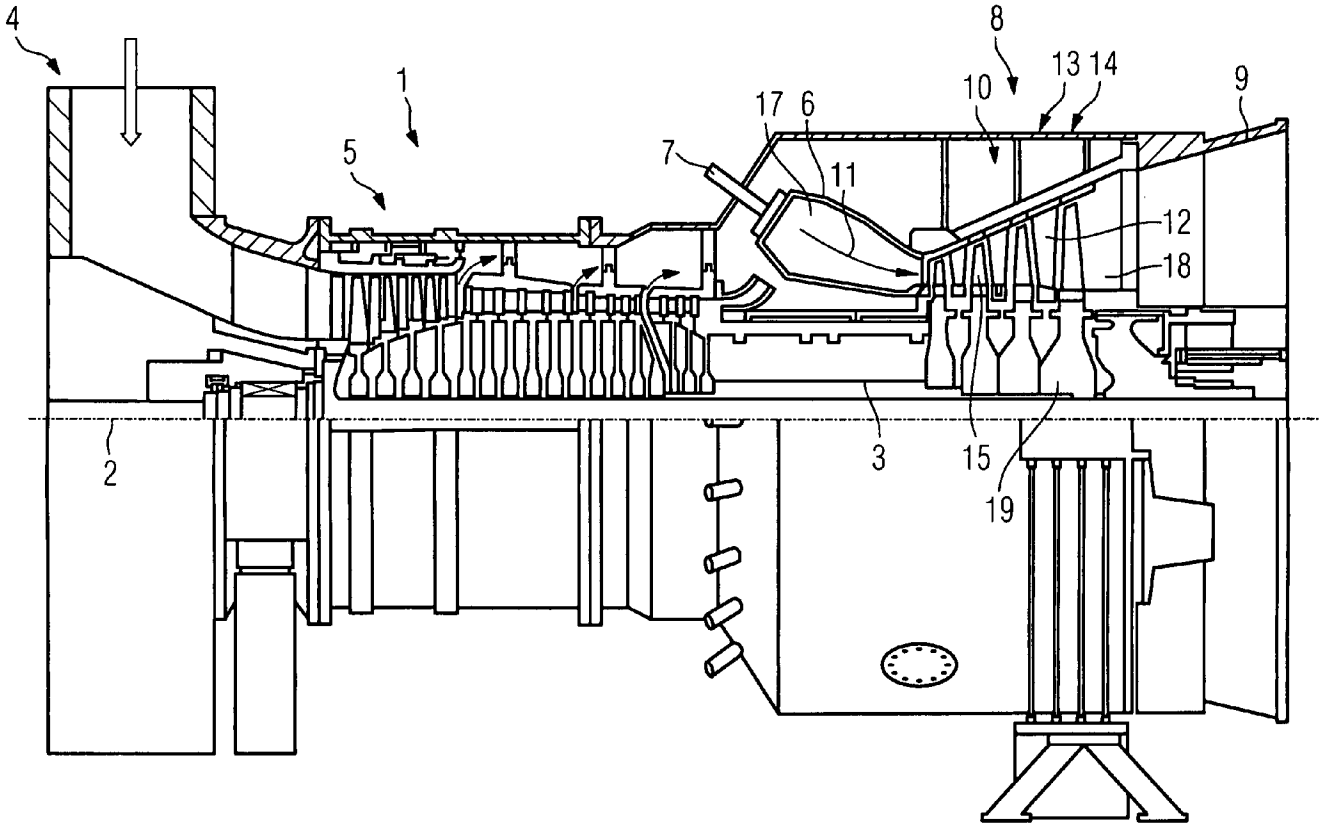
FIG. 1 shows a gas turbine in a longitudinal partial section.

FIG. 1 shows a gas turbine 1 in a longitudinal partial section. In the interior, it has a rotor 3 which is rotatably mounted about a rotation axis 2 and is also referred to as turbine rotor. Following one another along the rotor 3 are an intake casing 4, a compressor 5, a torus-like annular combustion chamber 6 having a plurality of burners 7 arranged in a rotationally symmetrical manner relative to one another, a turbine unit 8 and the exhaust-gas casing 9. The annular combustion chamber 6 forms a combustion space 17 which communicates with an annular hot-gas duct 18. Four turbine stages 10 connected one behind the other form the turbine unit 8 there. Each turbine stage 10 is formed from two blade rings. As viewed in the direction of flow of a hot gas 11 produced in the annular combustion chamber 6, a row 14 formed from moving blades 15 in each case follows a guide-blade row 13 in the hot-gas duct 18. The guide blades 12 are fastened to the stator, whereas the moving blades 15 of a row 14 are attached to the rotor 3 by means of a turbine disk. A generator or a driven machine (not shown) is coupled to the rotor 3.

Figure 2:
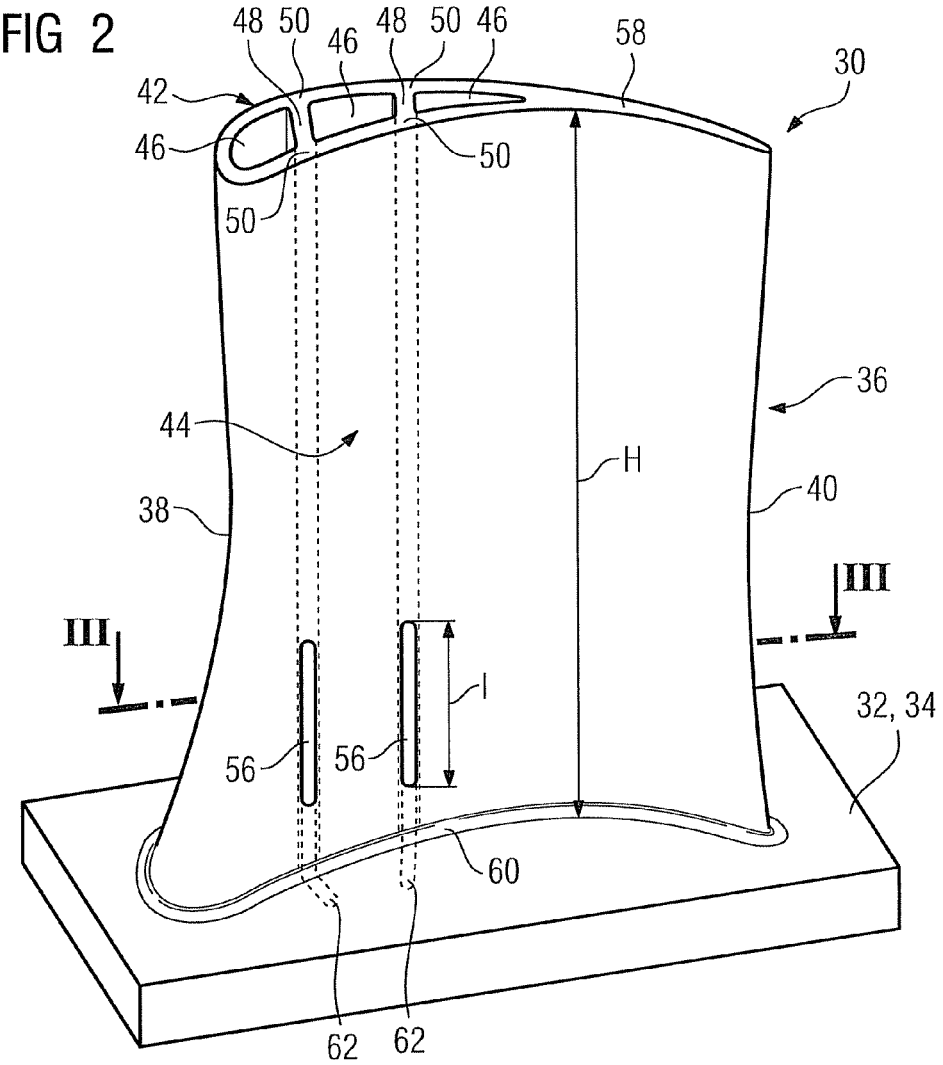
FIG. 2 shows a perspective view of a turbine blade according to the invention.

FIG. 2 shows a turbine blade 30 according to the invention in a perspective view. The turbine blade 30 has a platform 32, on the surface 34 of which an airfoil profile 36, around which the hot gas 11 can flow, is arranged. The airfoil profile 36 extends from a leading edge 38 to a trailing edge 40. In addition, it has a suction-side profile wall 42 running in between and also a pressure-side profile wall 44 likewise running in between.

Provided in the turbine blade 30 are, for example, three cavities 46, which are separated from one another by two supporting ribs 48. The supporting ribs 48 connect the suction-side profile wall 42 to the pressure-side profile wall 44 and serve to increase the rigidity of the airfoil profile 36.

As a rule, the turbine blade 30 is produced by a casting process. To this end, three casting cores are inserted in a casting device and are removed from the latter after the turbine blade 30 has been produced. The cavities 46 remain behind at this location, the supporting ribs 48 being arranged between said cavities 46. In a cast turbine blade 30, therefore, the supporting ribs 48 merge integrally into the suction-side and/or pressure-side profile wall 42, 44 in a connecting region 50 and are connected in one piece to said profile walls, a factor which produces a very good thermal coupling of the profile wall 42, 44 to the supporting rib.

When the turbine blade 30 is used in a gas turbine 1, the airfoil profile 36 around which the hot gas 11 flows is completely heated. In this case, in the turbine blade known from the prior art, a temperature profile having a local temperature minimum in the region of each supporting rib 48 has occurred hitherto in the material of the airfoil profile 36 in the direction of flow of the hot gas 11, that is to say from the leading edge 38 to the trailing edge 40. This non-uniform heating of the airfoil profile 36 caused by the cooler supporting rib 48 has caused such high, thermally induced stresses in that section of the profile walls 42, 44 which is close to the surface that cracks have been able to develop there and crack growth has occurred repeatedly. This has restricted the service life of the known turbine blade.

According to the invention, in order to ensure a more uniform temperature profile from the leading edge 38 to the trailing edge 40 in the profile walls 42, 44, the slot 56 provided in a profile wall 42, 44 on the hot-gas side is now arranged in a section of the profile wall 42, 44 which is opposite the connecting region 50 and is therefore also opposite the supporting rib 48. The slot 56 raises the local temperature minimum occurring in its region, since the thermal conductivity of the connecting region 50 has been reduced on account of the reduced cross section. Accordingly, the temperature gradients along the profile walls 42, 44 from the leading edge 38 to the trailing edge 40 are reduced, which has a stress-reducing effect in the section having the slot 50. The thermal stresses are then at a harmless level and the material of the airfoil profile 36 can thus withstand for a longer period the loads that occur.

The slots 56 have a minimum length L which corresponds to at least 10%, preferably at least 20%, of the height H of the airfoil profile 36. The height H of the airfoil profile 36 is determined between the surface 34 of the platform 32 and the tip 58 of the airfoil profile 36.

Since the local temperature minimum occurs in particular in that region of the airfoil profile 36 which is close to the platform, the slot 56 can extend into a rounded-off transition region 60 which is arranged between the platform 32 and the airfoil profile 36. This configuration of the slots 56 is illustrated by the contours 62 shown by a broken line style. In addition, especially good protection against crack-like wear can be achieved if the slot 62 also extends right into the platform 32.

Figure 3:
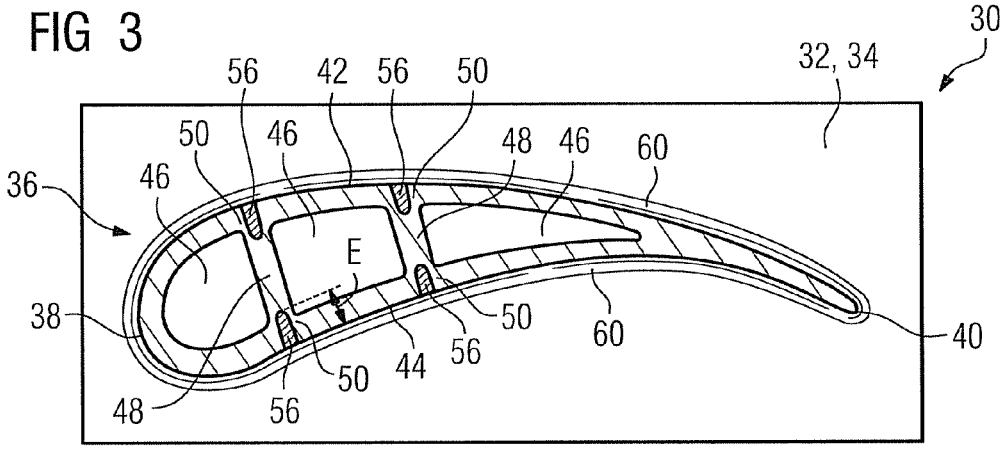
FIG. 3 shows the cross section along section line III of the turbine blade according to FIG. 2.

FIG. 3 shows a section through the turbine blade 30 according to the invention along section line III-III from FIG. 2. The turbine blade 30 may be designed as a moving blade and/or as a guide blade for an, in particular stationary, gas turbine 1.

The airfoil profile 36 shown in cross section shows the leading edge 38, the trailing edge 40, the suction-side profile wall 42, the pressure-side profile wall 44 and two supporting ribs 48, which separate the cavities 46 and which each merge in a connecting region 50 into the profile walls 42, 44. In the sectional illustration according to FIG. 3, the slots 56 shown are filled with a filler, as a result of which an especially aerodynamic surface contour of the airfoil profile 36 can be produced. Projections and edges running transversely to the direction of flow of the hot gas 11 are thus avoided in the profile walls 42, 44.

The slots 56 each project with a penetration depth E into the profile walls 42, 44. Said penetration depth E may be of such a size that the slots 56 project into the connecting region 50 and if need be even beyond that into the supporting ribs 48. This ensures that the temperature difference along the airfoil profile 36 from the leading edge 38 to the trailing edge 48 is evened out in an especially effective manner in order thus to further increase the service life of the turbine blade 30.

The invention is especially effective if a coolant, for example compressor air extracted from the compressor 5 of the gas turbine 1, flows through the hollow turbine blade 30 and the airfoil profile 36. In this case, the profile walls 42, 44, in accordance with the requirements, are certainly cooled from the interior, but so, too, are the supporting ribs 48. The undesirable local input of coldness or the local heat dissipation from the profile wall 42, 44 via the connecting region 50 and via the supporting ribs 48 is especially effective on account of the especially good thermal coupling. Accordingly, the temperature differences along the profile walls 42, 44 and therefore also the thermal stresses in an internally cooled turbine blade 30 are especially high. The service life in particular of internally cooled turbine blades 30 can thus be prolonged in an especially effective manner by the invention.

The slots 56, which serve for the thermal relief, may also be provided in only one profile wall, for example the suction-side profile wall 42 or the pressure-side profile wall 44. In addition, the slots 56, 62 serve as boundaries for cracks produced in the adjacent blade material. If there is a crack in one of the two profile walls 42, 44, for example in the region of the center cavity 46, and if this crack extends in the direction of flow of the hot gas 11, it inevitably expands at most up to one of the two slots 56. It is not possible for the crack to extend beyond the slot 56.

On the whole, the invention specifies a measure for evening out the thermal stress in an airfoil profile 36 of a turbine blade 30 in order to increase the service life of the turbine blade 30 and therefore increase the operating periods of a gas turbine 1 equipped with said turbine blade 30. To this end, the invention proposes that the hollow turbine blade 30 have slots 56 arranged on the hot-gas side, for relief purposes, in the region of the supporting ribs 48 which connect a suction-side profile wall 42 to a pressure-side profile wall 44 in a respective connecting region 50.

The invention claimed is:

1. A hollow turbine blade, comprising:

a platform arranged at a radially inward location of the blade having a blade axis extending radially outward from the platform;

a profile tip arranged opposite the platform;

a suction-side profile wall arranged between the profile tip and the platform extending along the blade axis, the suction-side profile wall having an outward side and an inward side;

a pressure-side profile wall arranged opposite the suction-side profile wall and between the profile tip and the platform around which a hot gas can flow, the pressure-side profile wall having an outward side and an inward side;

an airfoil profile where a hot gas flows formed along the outward side of the suction-side profile wall and the outward side of the pressure-side profile wall having a profile height;

a blade interior portion defined by the inward sides of the suction-side and pressure-side profile walls;

a supporting rib arranged in the interior portion of the turbine blade and connects the pressure-side profile wall to the suction-side profile wall in a connecting region formed by the supporting rib and the profile wall; and a slot arranged within the pressure-side profile wall opposite the supporting rib in the connecting region, and wherein the slot includes a length that extends into the supporting rib and a first width that is less than a second width of the supporting rib.

2. The turbine blade as claimed in claim 1, wherein the slot extends along the blade axis and includes a height of at least 10% of the profile height.

3. The turbine blade as claimed in claim 2, wherein the slot extends along the blade axis and includes the height of at least 20% of the profile height.

4. The turbine blade as claimed in claim 1, wherein the slot is filled with a filler.

5. The turbine blade as claimed in claim 4, wherein the filler is softer than the material of the profile wall.

6. The hollow turbine blade as claimed in claim 1, further comprising:

a plurality of cavities each disposed on the interior portion of the turbine blade and separated from each other by the supporting rib, and a filler separate from each of the plurality of cavities such that no fluid flow from any cavity to the slot.

7. A hollow turbine blade, comprising:

a platform arranged at a radially inward location of the blade having a blade axis extending radially outward from the platform;

a profile tip arranged opposite the platform;

a suction-side profile wall arranged between the profile tip and the platform extending along the blade axis, the suction-side profile wall having an outward side and an inward side;

a pressure-side profile wall arranged opposite the suction-side profile wall and between the profile tip and the platform around which a hot gas can flow, the pressure-side profile wall having an outward side and an inward side;

an airfoil profile where a hot gas flows formed along the outward side of the suction-side profile wall and the outward side of the pressure-side profile wall having a profile height;

a blade interior portion defined by the inward sides of the suction-side and pressure-side profile walls;

a supporting rib arranged in the interior portion of the turbine blade and connects the pressure-side profile wall to the suction-side profile wall in a connecting region formed by the supporting rib and the profile wall; and a slot arranged within the pressure-side profile wall opposite the supporting rib in the connecting region, wherein the slot extends into a rounded-off transition region arranged between the platform and the airfoil profile following the contour of the rounded-off transition region.

8. The turbine blade as claimed in claim 7, wherein the slot extends into the platform following the contour of the platform.

9. The turbine blade as claimed in claim 7, wherein the slot is filled with a filler.

10. The turbine blade as claimed in claim 9, wherein the filler is softer than the material of the profile wall.

11. A cooled turbine blade, comprising:

a platform portion arranged at a radially inward location of the blade having a blade axis extending radially outward from the platform;

a tip portion arranged opposite the platform portion;

a leading edge arranged essentially parallel the blade axis and extending from the platform portion to the tip portion;

a trailing edge arranged downstream from the leading edge;

a suction-side wall arranged between the leading edge and trailing edge having an outward facing side and an inward facing side;

a pressure-side wall arranged opposite the suction-side wall and between the leading edge and trailing edge having an outward facing side and an inward facing side;

an airfoil profile where a hot gas flows formed along the outward facing sides of the suction and pressure side walls;

a blade interior portion defined by the inward sides of the suction-side walls and pressure-side walls where a coolant fluid flows;

a supporting rib arranged in the interior portion of the turbine blade and connects the pressure-side profile wall to the suction-side profile wall in a connecting region foimed by the supporting rib and the profile wall;

a slot arranged in the pressure-side profile wall opposite the connecting region where the slot inhibits the growth of thermal stress induced cracks in the blade; and a filler material that fills the slot, wherein the slot extends into a rounded-off transition region arranged between the platform and the airfoil profile following the contour of the rounded-off transition region.

12. The gas turbine engine as claimed in claim 11, wherein the filler is separate from a cavity.

13. The cooled turbine blade as claimed in claim 11, wherein the slot is separate from the cavity.

14. A gas turbine engine having a rotational axis, comprising:

an inlet that admits a working fluid;

a compressor that provides a compressed working fluid and a compressed partial flow;

a combustion chamber that mixes a fuel with the compressed working fluid and combusts the mixture to faun a hot working fluid;

a turbine that expands the hot working fluid having:

a turbine disk inline with the rotational axis, a plurality of cooled turbine blades mounted to the turbine disk having:

a platform portion with a blade axis extending perpendicular to the rotor axis, a tip portion arranged opposite the platform portion, a leading edge arranged essentially parallel the blade axis and extending from the platform portion to the tip portion, a trailing edge arranged downstream from the leading edge, a suction-side wall arranged between the leading edge and trailing edge having an outward facing side and an inward facing side, a pressure-side wall arranged opposite the suction-side wall and between the leading edge and trailing edge having an outward facing side and an inward facing side, an airfoil profile where a hot gas flows formed along the outward facing sides of the suction and pressure side walls, a blade interior portion defined by the inward sides of the suction-side walls and pressure-side walls where a coolant fluid flows, a supporting rib arranged in the interior portion of the turbine blade and connects the pressure-side profile wall to the suction-side profile wall in a connecting region formed by the supporting rib and the profile wall, a slot arranged in the pressure-side profile wall opposite the connecting region, wherein the slot is separate from each adjacent cavity wherein no fluid flows from each of the adjacent cavities to the slot, each cavity is disposed on the interior of the turbine blade separated from another cavity by the supporting rib.

15. The gas turbine as claimed in claim 14, wherein the turbine comprises a plurality of turbine disks.

* * * * *